United States Patent [19]

Kozlowski

[11] Patent Number: 4,829,817

[45] Date of Patent: May 16, 1989

[54] SOIL-PERCOLATION TESTING METHOD AND APPARATUS

[76] Inventor: Louis P. Kozlowski, Marsh Rd., Dudley, Mass. 01570

[21] Appl. No.: 128,928

[22] Filed: Dec. 4, 1987

[51] Int. Cl.[4] ..... E21B 47/00

[52] U.S. Cl. ..... 73/155; 73/38

[58] Field of Search ..... 73/38, 155, 171, 290 B; 33/126, 126.4 R, 126.7 R, 126.7 A; 172/21

[56] References Cited

U.S. PATENT DOCUMENTS

| | | | |
|---|---|---|---|
| 1,016,616 | 2/1912 | Emerson | 33/126.4 R |
| 1,353,193 | 9/1920 | Townsend | 33/126.4 R |
| 1,987,579 | 1/1935 | Rush | 116/118 |
| 2,464,038 | 3/1949 | Horth | 172/21 |
| 2,585,680 | 2/1952 | Quist | 33/126.4 R |
| 2,966,879 | 1/1961 | Farrell | 116/118 |
| 3,161,175 | 12/1964 | Taylor | 116/118 |
| 3,613,310 | 10/1971 | Rynberk | 47/48.5 |
| 3,712,139 | 1/1973 | Harvey | 73/428 |
| 3,945,247 | 3/1976 | Anderson | 73/155 |
| 4,099,406 | 7/1978 | Fulkerson | 73/73 |
| 4,341,110 | 7/1982 | Block | 73/73 |

FOREIGN PATENT DOCUMENTS

| | | | |
|---|---|---|---|
| 2159274 | 11/1985 | United Kingdom | 33/126.7 R |

*Primary Examiner*—Stewart J. Levy
*Assistant Examiner*—Kevin D. O'Shea
*Attorney, Agent, or Firm*—Donald S. Holland

[57] ABSTRACT

An improved method and apparatus for taking soil percolation tests. In the preferred embodiment the apparatus comprises a threaded shaft; a plurality of marking discs that can be selectively positoned along the shaft at predetermined gradations; a positioning brace that overlies the shaft for securing the shaft in vertical alignment; a mounting disc affixed near a base end of the shaft that becomes flush with the soil when the shaft is inserted into a percolation test hole; and a receiving disc near a top end of the shaft for receiving the positioning brace as it straddles the test hole. In using the device, the person administering the test adjusts the marking discs along the shaft to predetermined gradations; secures the device within a percolation test hole; fills the hole with water; observes from a remote distance the descent of the column of water within the hole; observes the formation of a meniscus around a first marking disc below which the column of water has descended; and records the time variable when a wave appears on the surface of the water resulting from the snap of the meniscus as the column of water descends further below the first and subsequent marking discs.

9 Claims, 2 Drawing Sheets

SOIL-PERCOLATION TESTING METHOD AND APPARATUS

BACKGROUND OF THE INVENTION

The present invention relates to devices for measuring the rate of infiltration of liquids into soil. Such devices are generally known as percolation gauges or percolation testing devices.

Determining the rate at which liquids will infiltrate a soil is often important in ascertaining the potential of a specific soil for a particular use. Most frequently, infiltration rates are measured to determine the surface area requirements of underground sewage disposal systems. Additionally, rainwater run-off sites, adjacent proposed asphalt or other ground covering development projects, must be evaluated as well.

When water or other liquids infiltrate a soil, some of the liquid will be absorbed by the sponge-like soil particles. Any remaining liquid will percolate or leach through the soil, by the force of gravity, to underground drainage areas. The relative amount of liquid that can percolate through the soil depends primarily on the level of the soil's saturation. If the soil is thoroughly saturated, any additional liquid will be forced to percolate through it.

Unfortunately, in testing the rate of infiltration, it is impossible to completely saturate a test soil. Consequently, any measurements necessarily include both the rates of absorbed and percolated liquid as sub-components of the overall infiltration rate. Typically, the test soil is "pre-soaked" in an attempt to approximate a heavy saturation of the soil. In some regions, the tests are only given during the wettest times of the year to increase the probability that the soil will be as saturated as possible.

After a set pre-soak period, measurement of water infiltration takes place. In the art, these measurements have come to be known as "percolation" tests, although the term is not accurate. For example, a particularly porous or sandy soil may absorb all test liquid even though none of the water percolates through a fine-particle, or clay-like, soil layer beneath the sandy soil. Nonetheless, the soil would have performed well in the "percolation" test. Because it is common in the art, as shown in the references cited below, the term "percolation" will hereafter, for the purposes of this specification, be interpreted as being synonymous with the term "infiltration", as described above.

A percolation test is administered at a test site by excavating the subject soil at least to the level of the proposed liquid input, e.g., the level of output of a septic tank's effective leeching field. Then, a test hole or "bore hole" is dug, generally twelve inches wide and eighteen inches deep. Water is poured into the test hole until it reaches a certain depth. Typically, a specific pre-soak period is prescribed, during which the water level in the test hole is maintained at a constant height. After that period, no more water is added and either the height of the water in the test hole is recorded at set time intervals or the time is recorded for that height to descend to incremental levels.

Many problems exist in both the apparatus and method used to effect such measurements. Initially, simple measuring sticks or rulers were inserted into the test hole at the prescribed times and the height of the column of water visually observed and recorded. Or, the ruler was left in the hole and the times recorded when the water level had descended to the prescribed incremental heights.

Such methods invited numerous problems. For example, inserting rulers at different intervals ignored possible alteration of the depth of the test hole due to changes in the soil at its bottom. Also, other problems arose if the person recording the measurements had to move in and out of the excavation site, next to the test hole, to take the readings at the various intervals. This increased the possibility of debris falling into the test hole, or even its collapse.

Additionally, the prior measurement apparatus forced observers to stand almost over the test holes to view the results, further encouraging disruption of a hole. Also, the results from "ruler-type" testers were difficult to view. As the water descended toward the bottom of the test holes, those testers were difficult to read because they included no clearly visible gradation markings.

Improvements over the early percolation test art are well known U.S. Pat. Nos. 3,945,247, 4,099,406 and 4,341,110 all disclose free standing cylinders with complicated mechanisms for remotely measuring the percolation test results. These types of percolation test devices avoid many of the problems of the older art associated with intrusion upon the test hole and viewing the measuring device. Nonetheless, use of complex mechanical timers, electrical probes, and electro-mechanical marking devices under all-weather environmental conditions have rendered such types of apparatus costly and unreliable.

Accordingly, it is the primary object of the present invention to provide a new method and apparatus for administering percolation tests that affords remote observation of the test results without the need for complicated electro-mechanical timing and marking components.

It is another object to provide a new percolation testing method which produces reliable and consistent results.

It is another object to provide a percolation testing method wherein the person administering the test can record the results without having to descend into the excavated site near the test hole.

It is yet another object to provide a percolation testing apparatus having gradation indicators that are easily adjustable so that the apparatus may be utilized both in tests that record the time variable and tests that record variations in water height.

It is a further object to provide a percolation testing apparatus that is durable, yet of simple construction and therefore inexpensive to manufacture.

The above and other objects and advantages of this invention will become more readily apparent when the following description is read in conjunction with the accompanying drawings.

SUMMARY OF THE INVENTION

A simple apparatus is disclosed that allows remote observation of specific gradations in the declining height of a column of water. The device is inserted into a test hole at the bottom of an excavated site. A prescribed volume of water is then supplied to the hole. A person administering the test then leaves the excavated site and records the test results by observing the device from beyond the excavated site.

In the preferred embodiment, the testing device comprises a threaded shaft; a plurality of marker discs that can be selectively positioned along the mid-length of the shaft at predetermined gradations; a mounting disc near the bottom of the shaft that becomes flush with the bottom of a test hole, upon insertion of the shaft into the hole; and a positioning brace that overlies the top of the shaft and straddles the test hole to keep the shaft in a stable vertical alignment.

Typically, where the percolation test records the time it takes for the height of the water to drop specific intervals, a first marker disc is secured six inches above the mounting disc and additional marker discs are secured at one-inch intervals up to six or twelve inches above the first marking disc. If the percolation test records the height-of-water variable at set time intervals, the marker discs are simply adjusted so that a disc is secured at each one-inch, or one-half-inch, interval from the mounting disc throughout the length of the shaft.

To administer the percolation test with the present invention, the marking discs are first set at predetermined intervals. Then, the test device's shaft is inserted into the test hole; the brace is secured; and the hole is pre-soaked and filled with water. As the water descends to the level of the first marker disc, nearest the top of the shaft, a meniscus forms around the disc. As the water level continues to descend, eventually the meniscus snaps, creating a wave or ripple across the surface of the water. The wave or ripple is clearly visible to the person administering the test while he remains outside the excavated site, enabling easy recording of the time the water-level reached the particular gradation. If the test is recording water height at particular times, the discs themselves are clearly visible to the observer, enabling easy recording of the water's height at any desired time.

DETAILED DESCRIPTION OF THE PREFERRED EMBODIMENTS

Figures 1, 2, 3, 4:
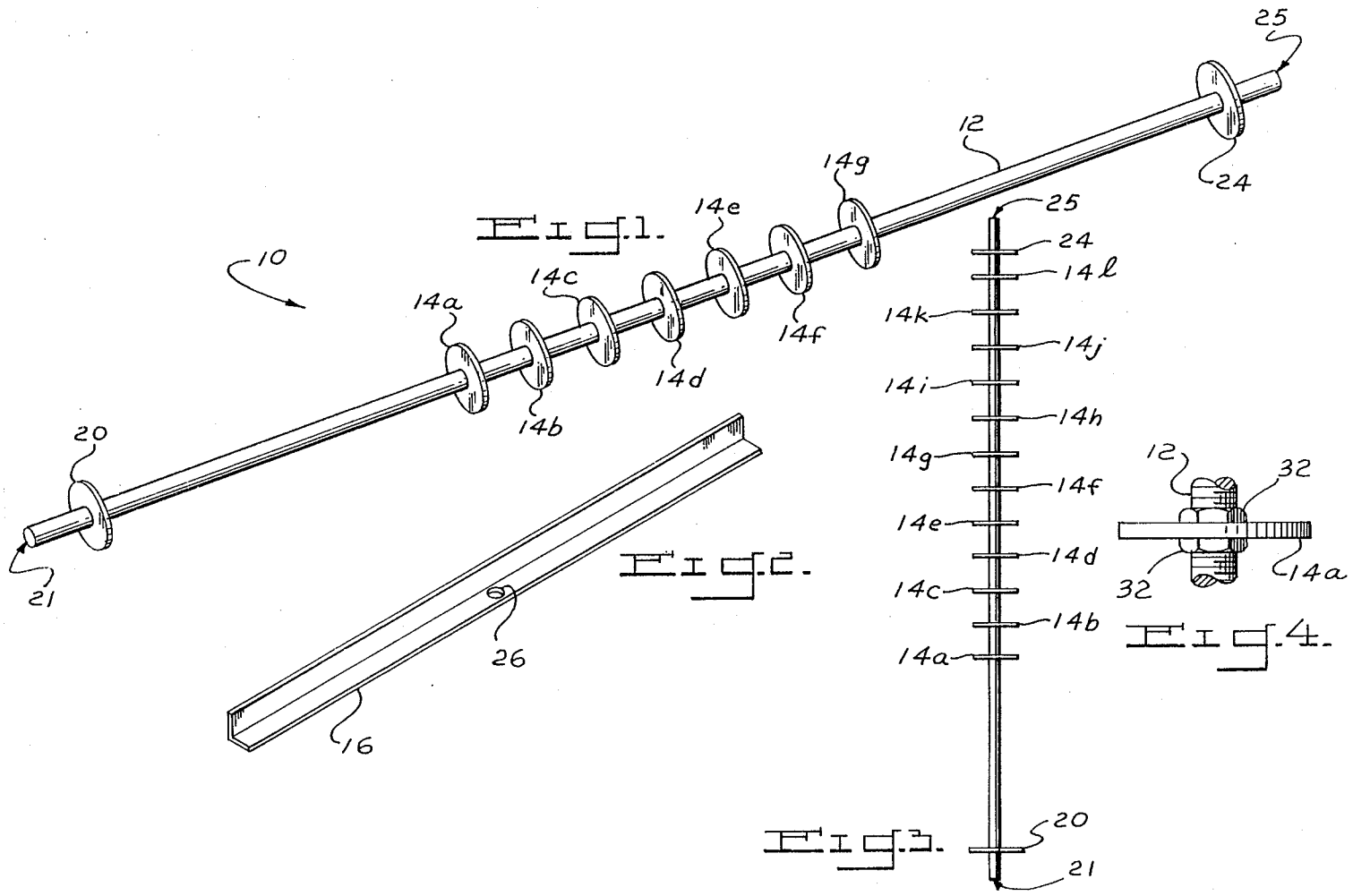
FIG. 1 is a perspective view of a soil-percolation testing device constructed in accordance with the present invention, wherein the device has a plurality of adjustable discs for measuring the time it takes a descending column of water to reach predetermined heights.
FIG. 2 is a positioning brace used in accordance with the preferred embodiment of the present invention.
FIG. 3 is a side plan view showing the FIG. 1 device with extra discs affixed for measuring the height of a descending column of water at predetermined time intervals.
FIG. 4 is an enlarged fragmentary portion of FIG. 3, showing a disc and the means for securing its position on the threaded shaft.

Referring to the drawings in detail, the preferred embodiment of a soil-percolation testing device is shown and generally designated by the reference numeral 10 (see FIG. 1). The invention basically comprises a threaded shaft 12; a plurality of marking discs (14*a,b,c,d,e,f,g* in FIG. 1; plus 14*h,i,j,k,l* in FIG. 2) that can be selectively positioned along the mid-length of the shaft 12 at predetermined gradations; a positioning brace 16 that overlies the shaft 12 for securing the shaft in vertical alignment; a mounting disc 20 affixed adjacent a base end 21 of the shaft that becomes flush with the soil at the bottom 22 of a percolation test hole 23 upon insertion of the shaft 12 into the hole; and a receiving disc 24 adjacent a top end 25 of the shaft 12 for mounting the positioning brace 16 when the brace is placed across the test hole, overlying the top end 25 of the shaft 12.

The threaded shaft 12 is made of any suitably hard metal such as stainless steel. All of the invention's other components are also preferably made of stainless steel for simplicity. However, other hard material, such as durable plastic, could be substituted.

The positioning brace 16 can be fashioned from standard angle iron; or it can be flat stock. In the middle of it is a throughbore 26 for receiving the top end 25 of the threaded shaft when the soil-percolation testing 10 device is inserted within a test hole 23 (see FIG. 5).

Figure 5:
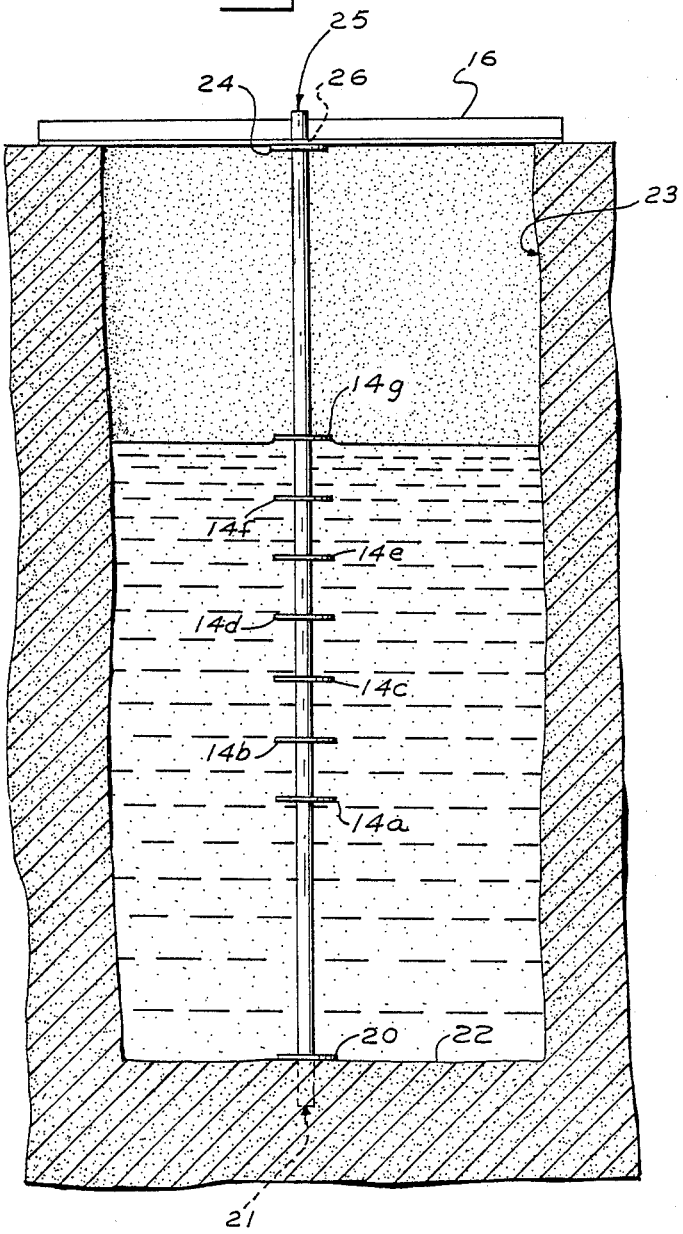
FIG. 5 is a side plan view of the FIG. 1 device in a test hole, with a positioning brace in place and water forming a meniscus around a marker disc.

As best shown in FIGS. 1 and 5, near the base end 21 of the threaded shaft 12 the mounting disc 20 is positioned slightly upward along the shaft 12. This allows the shaft to be easily forced into the soil at the bottom 22 of the test hole 23 until the mounting disc 20 is flush with the soil level. For most soils, if the mounting disc 20 is approximately one inch above the base end 21 of the shaft, little exertion is needed to properly mount the soil-percolation testing device 10 within the test hole. In some circumstances, such as very heavy or dense soils, the mounting disc is adequate to properly position the shaft 12 in a vertical alignment and no positioning brace 16 is required.

It has been found that, whether utilizing the soil-percolation testing device to measure the time variable at predetermined heights (see FIG. 1) or to measure the height of the column of water variable at predetermined times (see FIG. 3), the critical measurements all occur when the height of the water column is within the uppermost twelve inches of an eighteen-inch test hole 23. Consequently, the first marking disc 14*a* is affixed to the shaft 12 six inches above the mounting disc 20. The other marking discs, 14*b,c,d,e,f,g* in FIG. 1 and 14*b,c,d,e,f, g,h,i,j,k,l* in FIG. 3, are affixed at subsequent one-inch intervals above the first marking disc 14*a*.

As best shown in FIG. 1, when the soil-percolation testing device 10 is to be utilized in a test that measures the period of time required for the column of water to drop a predetermined distance, no marking discs 14*h,i,j,k,l* are required. This is because the first measurement starts at disc 14*g*. The next measurements are for the periods of time required for the water to drop the next six inches, or below the subsequent marker discs 14*f,e,d,c,b* and *a*.

As best shown in FIG. 3, if the test is to measure the height of the column of water at predetermined times, marker discs 14*a,b,c,d,e,f,g,h,i,j,k,l* are affixed at one-inch intervals. They start six inches above the mounting disc 20 with the first recording disc being 14*a*. The last disc 14*l* is affixed one inch below the positioning-brace receiving disc 24.

If finer gradations than one-inch intervals are required, additional discs at one-half inch intervals may be added. Also, if measurements are required for all the water n the test hole, which is often the case in especially porous soils, additional marking discs (not shown)

may be affixed at specific intervals between the mounting disc 20 and the first marking disc 14*a*.

Marking discs 14*a*-1, the mounting disc 20, and the positioning-brace receiving disc 24 are all adjustably affixed along the threaded shaft 12 by use of the common threaded nuts 32. One nut is screwed against either side of each of the discs, 14*a*-1, 20 and 24 (see FIG. 4). The marking discs 14*a*-1 may be adjusted by simply twisting the corresponding nuts 32 along the threaded shaft 12 to the desired position. Additional discs (not shown) can be positioned along the shaft 12 in like manner.

Figure 6:
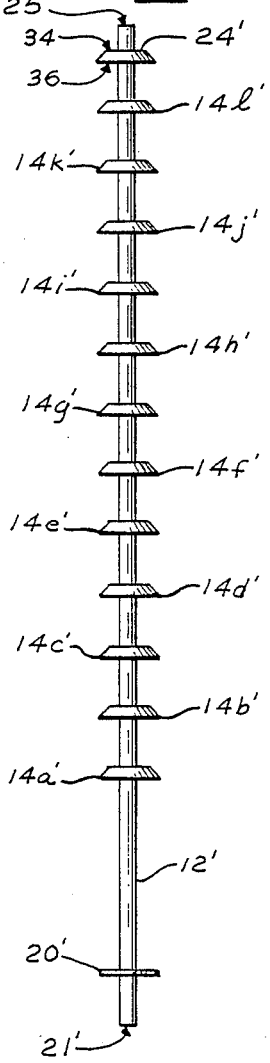
FIG. 6 is a side plan view of an alternative embodiment of a soil-percolation testing device, wherein the marking discs are in the form of inverted pie pans.

As best shown in FIG. 6, an alternative embodiment of the soil-percolation testing device is disclosed. Elements with similar counterparts in FIGS. 1–5 have been assigned the same reference numbers as their counterparts, but with primes after them. The only differences in this embodiment are that the marking discs 14*a*'-1' and the receiving disc 24' are in the shape of inverted pie pans. This structure enhances the ability of the person administering the percolation test to make accurate measurements. As the column of water in the test hole 23 descends, the upper, narrow portion 34 of the positioning-brace receiving disc 24' comes into the view of the observer. This signals the observer that very soon the descending column of water will form a meniscus around the lower, wider portion 36 of the disc 24'. Consequently, with the advance warning, the person administering the percolation test is less likely to lose his or her concentration and miss the wave caused by the snapping of the meniscus.

In operation, after the site is excavated to the appropriate depth, and a twelve-inch wide, eighteen-inch deep hole 23 is prepared, the soil-percolation testing device 10 is ready for use. The observer or person administering the test inserts the device into the hole and applies sufficient pressure to force the base end 21 of the threaded shaft 12 into the soil, bringing the mounting disc 20 flush with the bottom of the test hole.

The positioning brace 16 is placed to traverse the top of the test hole 23 and aligned such that the top end 25 of the shaft 12 passes through the throughbore 26 in the positioning brace 16. If the test hole 23 is exactly eighteen inches deep, the positioning brace 16 would rest upon the positioning-brace receiving disc 24. If the hole is slightly deeper, the brace 16 will sit above the receiving disc. (Most test holes have to be at least eighteen inches deep.) The observer adjusts the positioning brace 16 so that the threaded shaft 12 is in a vertical alignment.

The test hole is then filled with the required quantity of water and "pre-soaked" if necessary. The observer then ascends out of the excavated site to begin observing the soil-percolation device 10. If the observer is recording the period of time required for the column of water to reach a predetermined height, the observer notes the time the marking disc (e.g., 14*f*) for that height appears. Then, he waits for a wave to appear, which is triggered by the snapping of the meniscus around that disc as the column of water descends below the disc. The observer records the time the wave occurs. If no visible wave is seen, the observer notes the time the complete marking disc appears instead.

If the observer is recording the height of the column of water at predetermined times, the observer simply counts the number of marking discs 14*a*-1 above the surface of the water at those specific times and correlates the exposed discs with their known heights. Extensive use has demonstrated that in all practical circumstances, the observer can easily perceive all measurements without descending back into the excavated site.

It should be understood by those skilled in the art that obvious structural modifications can be made without departing from the spirit of the invention. For example, the marking discs 14*a*-1 and 14*a*'-1' could be in alternating or distinctive colors, or labeled with height indicators, or of different and ascending diameters with the marking disc 14*a*, closest to the base end 21 of the shaft 12, having the largest diameter. Accordingly, reference should be made primarily to the accompanying claims rather than the foregoing specification to determine the scope of the invention.

Having thus described the invention, what is claimed is:

1. A method for testing the percolation rate of soils, comprising the steps of:

a. adjusting a plurality of marking discs on a threaded shaft to predetermined, measured height variables;
b. inserting the threaded shaft into the middle of a percolation-test hole;
c. filling the test hole with water;
d. observing the descent of the column of water around the threaded shaft within the test hole;
e. observing the formation of a meniscus around the outer perimeter of a first marking disc below which the column of water descends;
f. recording the time variable when a wave appears resulting from the snap of the meniscus as the column of water descends further below the first marking disc; and
g. recording the time variables when a wave appears resulting from the snap of the meniscus as the column of water descends below each subsequent marking disc.

2. The method of claim 1, further including the step of positioning an elongate brace over a top end of the threaded shaft for maintaining vertical alignment of the threaded shaft.

3. A method for testing the percolation rate of soils, comprising the steps of:

a. adjusting a plurality of marking discs on a threaded shaft to predetermined, measured height variables;
b. inserting the threaded shaft into the middle of a percolation-test hole;
c. filling the test hole with water;
d. observing the descent of the column of water around the threaded shaft within the test hole;
e. observing the formation of a meniscus around the outer perimeter of the first marking disc below which the column of water descends;
f. recording the height variables of the column of water on the threaded shaft after a predetermined period of time; and
g. recording the height variables of the column of water on the threaded shaft after each of a sequence of subsequent, predetermined time intervals.

4. The method of claim 3, further including the step of positioning an elongate brace over a top end of the threaded shaft for maintaining vertical alignment of the threaded shaft.

5. A soil-percolation testing apparatus, comprising:

a. a threaded shaft;
b. a plurality of marking discs adjustably connected along the shaft; and c. positioning means for positioning the shaft in vertical alignment when the shaft is being used to test soil percolation.

6. The apparatus of claim 5, wherein the positioning means comprises a mounting disc adjustably connected adjacent a base end of the shaft.

7. The apparatus of claim 5, wherein the positioning means comprises an elongate positioning brace having a central throughbore for receiving a top end of the shaft.

8. The apparatus of claim 7, wherein a positioning-brace receiving disc is adjustably connected adjacent the top end of the shaft.

9. The apparatus of claim 8, wherein a mounting disc is adjustably connected adjacent the base end of the shaft.

* * * * *